US005495942A

United States Patent [19]

Izhak

[11] Patent Number: 5,495,942

[45] Date of Patent: Mar. 5, 1996

[54] AUTOMATIC EXTENDING MEMBER SELECTOR

[76] Inventor: Allan Izhak, 2 High Point Dr., Poughkeepsie, N.Y. 12603

[21] Appl. No.: 326,316

[22] Filed: Oct. 20, 1994

[51] Int. Cl.[6] ..... A45C 11/32; B25G 3/38

[52] U.S. Cl. ..... 206/372; 7/168; 30/157; 70/456 R; 81/440; 206/37.8; 206/377

[58] Field of Search ..... 81/440; 30/157, 30/143; 70/456; 206/372, 375, 376, 377, 37.8, 37; 7/168

[56] References Cited

U.S. PATENT DOCUMENTS

| | | | |
|---|---|---|---|
| 2,411,168 | 11/1946 | Seely | 70/456 R |
| 2,590,307 | 3/1952 | Gibson | 206/377 |
| 2,630,212 | 3/1953 | Mosch | 70/456 R X |
| 2,701,052 | 2/1955 | Martel | 206/377 |
| 2,786,380 | 3/1957 | Rolland | 81/440 |
| 2,869,354 | 1/1959 | Huntley | 70/456 R |
| 3,943,801 | 3/1976 | Yates | 81/440 |
| 4,384,499 | 5/1983 | Shockley | 81/440 |
| 5,232,086 | 8/1993 | Montanari | 206/37.2 |

*Primary Examiner*—Bryon P. Gehman

*Attorney, Agent, or Firm*—Jordan B. Bierman; Bierman and Muserlian

[57] ABSTRACT

A device is described capable of selectively extending one member selected from a number of possible extending members, by a selector, full extension of the selected member being made under spring force applied by a rotating shaft.

14 Claims, 5 Drawing Sheets

AUTOMATIC EXTENDING MEMBER SELECTOR

The present invention is directed to an automatic selector and more specifically, to a device for automatically selecting an extending member such as a key, allen wrench, knife blade, screwdriver, or the like. The invention allows for the orderly organization of the extending members, while minimizing bulk, and allowing selection of the appropriate member, easily, quickly, and automatically.

BACKGROUND OF THE INVENTION

Although the invention can be used in combination with various extending members, the invention is particularly suitable for use as an automatic key selector, and will be described below, accordingly. The construction of the invention, and manner in which it operates will be substantially the same, regardless of the type of member being selected.

Most keys are currently organized using a simple key ring. These keys are bulky and cumbersome and, while on the key ring, can spread out in a haphazard manner, or be too bulky to fit in a clothing pocket. The key ring maintains the keys in order; however, the order of the keys needs to be memorized, or identified based on the key shape. Finding the correct key on a key ring often takes time, requires the use of two hands, and is extremely difficult in the dark.

To ease the identification of keys on a key ring, different shaped heads were used on the keys. This manner of identifying keys was found to be only minimally effective, however, as the shape of key heads on various keys were the same, or very similar. Similarly, keys were previously produced in different colors (gold or silver), and the heads of the keys were made in multiple colors. Identification of the keys, based on color, however, still required a search for the desired key, and was not helpful in the dark.

Another method for aiding in the identification of keys was a leather case, comprising rows of hooks to which the keys were attached. This method of organizing the keys, however, still required the user to manually open the case with two hands, visually identify the key, manually take the key from the case, and close the snap of the case when finished using the key. Over the years, a number of devices were designed in order to address the foregoing problems, and such are described, for example, in U.S. Pat. Nos. 1,943,844, 2,589,571, 2,634,599, 2,855,774, 3,618,346, 5,215,190, and 5,232,086. None of these prior art devices, however, allowed one to automatically extend a single selected key (or other extending member) from a plurality thereof.

SUMMARY OF THE INVENTION

In view of the foregoing, it is an object of the present invention to provide a device for selectively extending for use one member selected from a plurality of extending members, wherein the device is compact, and is easy to both use and manufacture.

Other objects and features of the present invention will become apparent from the following detailed description considered in conjunction with the accompanying drawings.

BRIEF DESCRIPTION OF THE DRAWINGS

FIGS *4a–4d* show various extending member configurations usable in the inventive device.

DETAILED DESCRIPTION OF THE INVENTION

Figure 2:
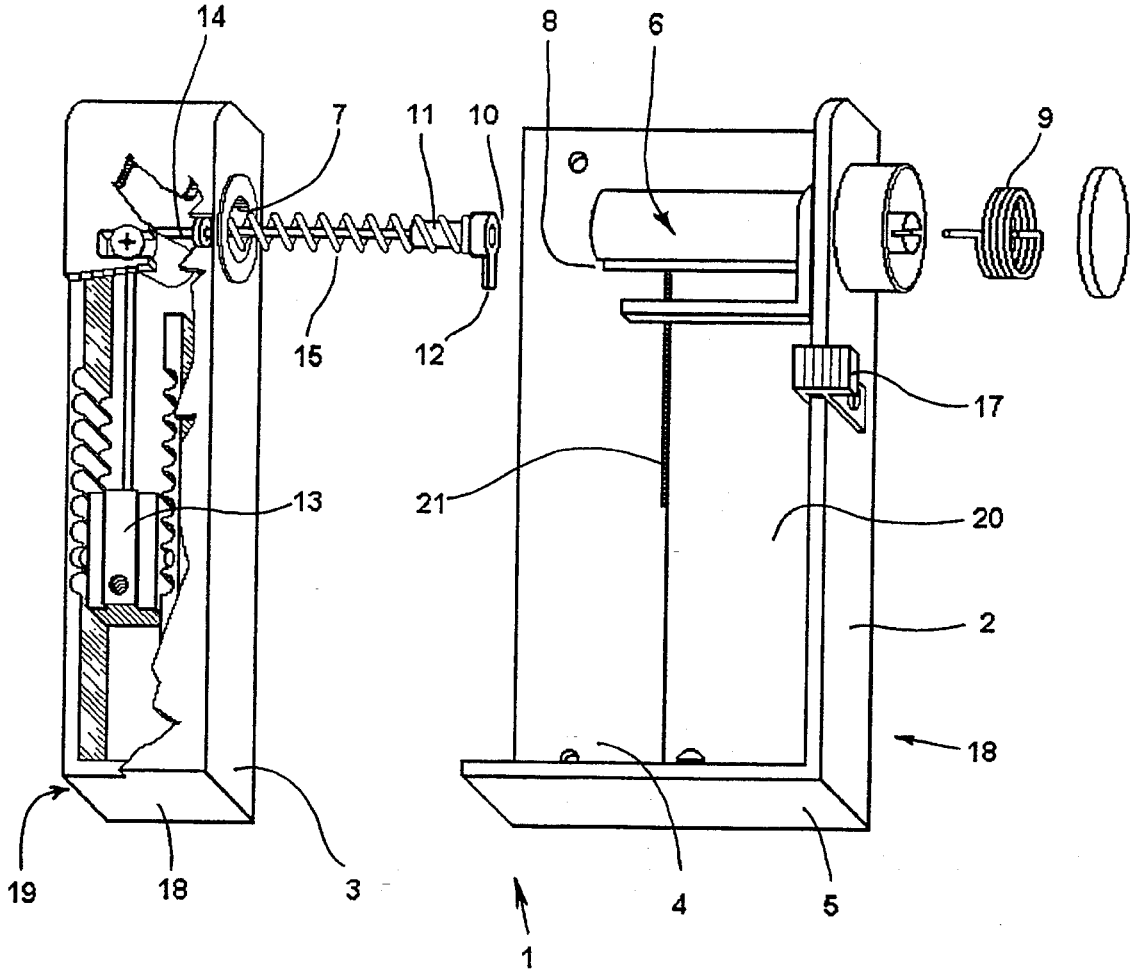
FIG. 2 is a partially sectioned, partially exploded view of the inventive device without the extending members in place.

Referring to FIG. 2, there is shown the inventive device for selectively extending one member selected from a plurality of extending members. It comprises frame assembly 1 including first side plate 2 and parallel second side plate 3, spaced apart from each other. Rear wall 4 connects first side plate 2 and second side plate 3 on at least one longitudinal edge thereof, and bottom plate 5 bridges the side plates at a bottom portion thereof. The combination of first side plate 2, second side plate 3, rear wall 4, and bottom plate 5 defines open cavity 6 of sufficient depth to encase the extending members, the cavity being open in a frontal position parallel to rear wall 4, and in a top position parallel to bottom plate 5.

Hollow shaft 7 extends between first side plate 2 and second side plate 3, shaft 7 being adapted to mate with mounting apertures formed in the extending members, whereby those members are rotatably mounted around shaft 7. Shaft 7 further has open raceway 8 formed therein, shaft 7 being biased to rotate by shaft biasing member 9.

Selector 10 allows for the selection of the member to be extended and comprises cylindrical member 11 having tailpiece 12 extending therefrom. Selector 10 is provided within the hollow of hollow shaft 7 with tailpiece 12 extending through raceway 8 to the exterior of shaft 7, thereby to contact the member selected for extension. The position of selector 10 is movable within shaft 7, between first side plate 2 and second side plate 3. The position of selector 10 is controlled by selector control 13 that preferably moves selector 10 via flexible connecting member 14 with and against the bias of selector biasing member 15.

Figure 3:
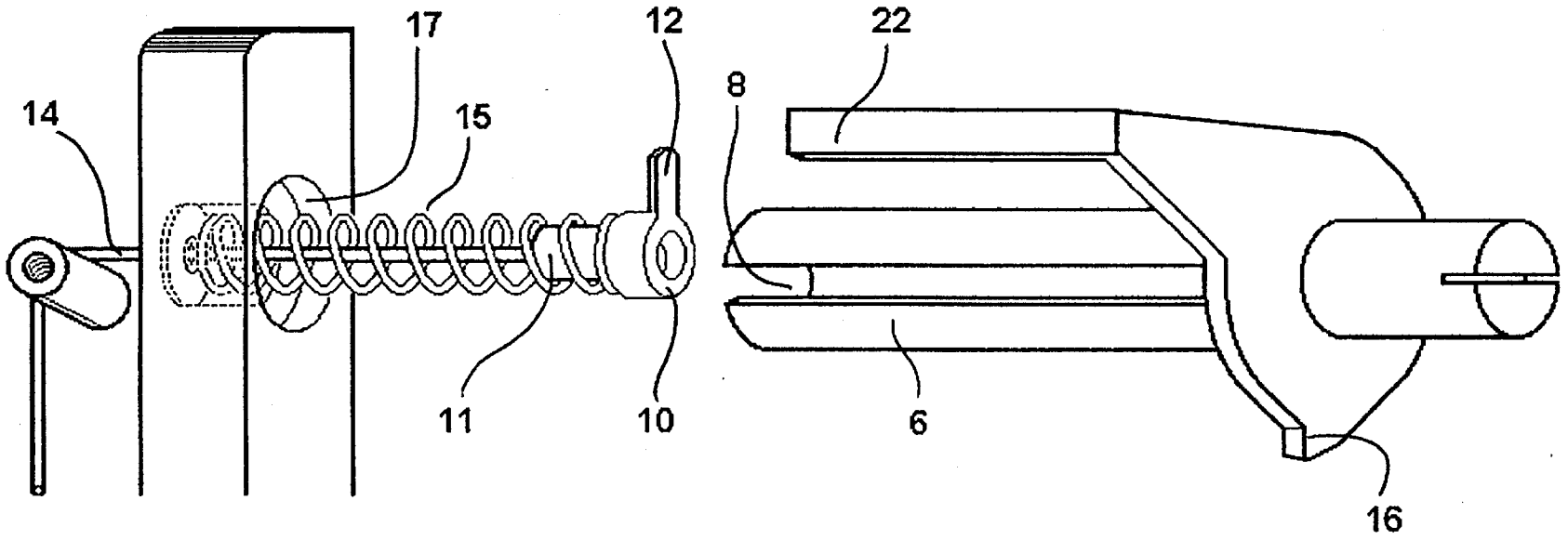
FIG. 3 is an exploded view illustrating the device for extending the selected extending member.
Figure 4A:
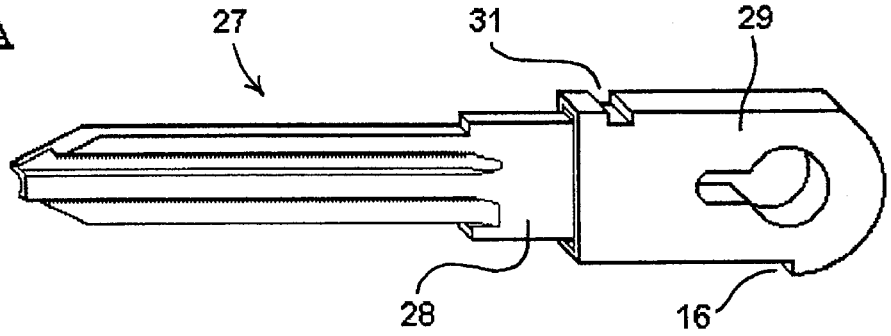
Figure 4B:
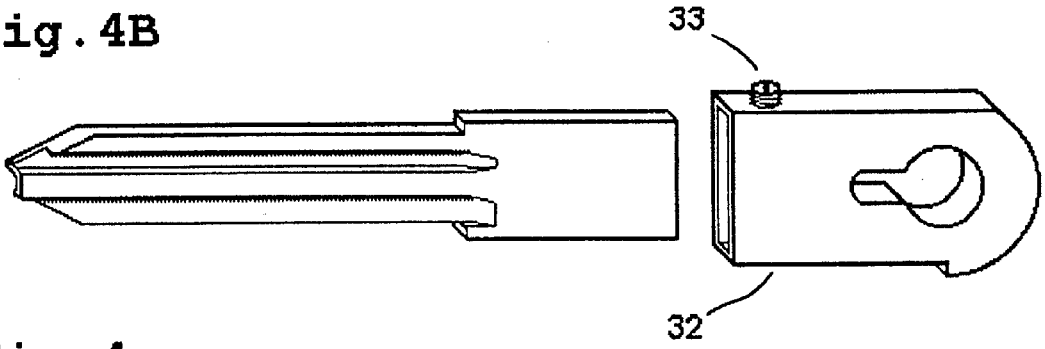
Figure 4C:
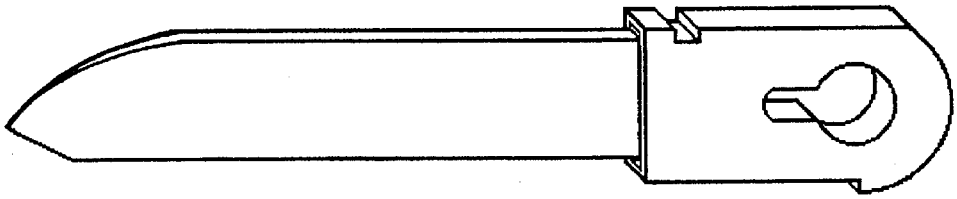
Figure 4D:
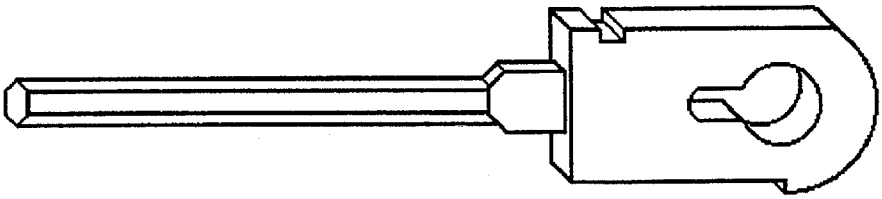

A more detailed view of shaft 7 and selector 10 is shown in FIG. 3. As can be seen therefrom, shaft 7 is provided with a retarding system which prevents shaft 7 from rotating. Release member 17 (shown in FIG. 2) releases the retarding system, whereby shaft 7 is rotated by force of shaft biasing member 9.

Referring again to FIG. 2, the frame assembly is preferably formed as two sections, first frame section 18 comprising first side plate 2, rear wall 4, and bottom plate 5. Second frame section 19 comprises the housing in which selector control 13 is disposed, the thickness of second section 19 being equal to the height of bottom plate 5 extending from rear wall 4 whereby second section 19 can be mounted on rear wall 4 so that one side of second section 19 comprises second side plate 3.

Figure 1:
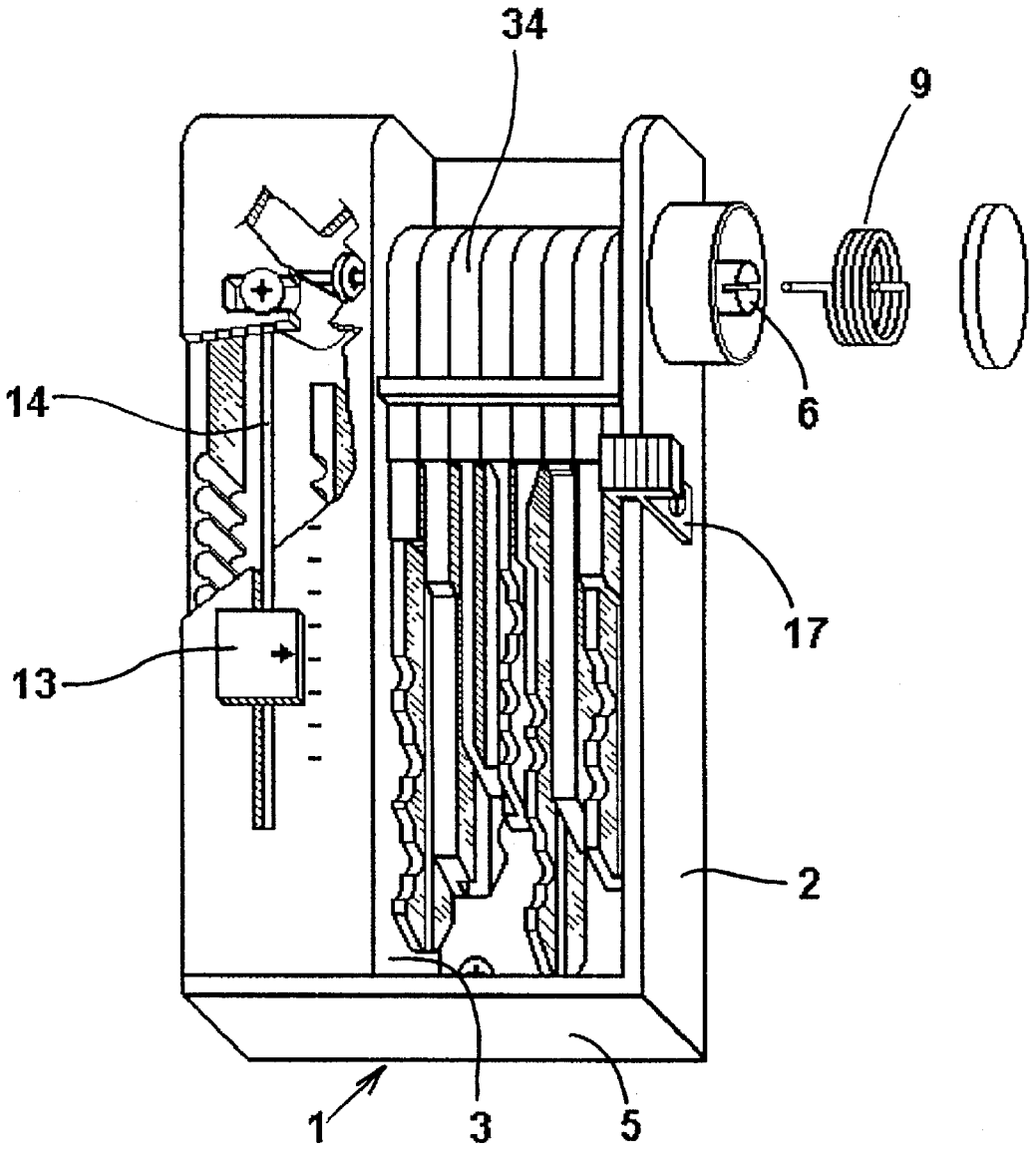
FIG. 1 is a partial cutaway, partially exploded view of the inventive device with the plurality of extending members in place.

Preferably, the retarding system comprises spring plate 20, a first edge of which, proximal to shaft 7, being spaced apart from rear wall 4 by spacing member 21. The first edge of spring plate 20 engages engaging tooth 16 to prevent rotation thereof. Activation of release member 17 causes depression of spring plate 20, whereby engaging tooth 16 is disengaged, and shaft 7 is free to rotate. Each of the extending members can also comprise engaging teeth, engaging the first edge of spring plate 20, whereby the extending members are prevented from rotation until release member 17 is activated. Shaft 7 can be further provided with armature 22 for holding the extending members until release member 17 is activated. Armature 22 further aids in returning the extending members to the closed position. The position of extending members 34 in the inventive device is shown in FIG. 1.

Figure 5:
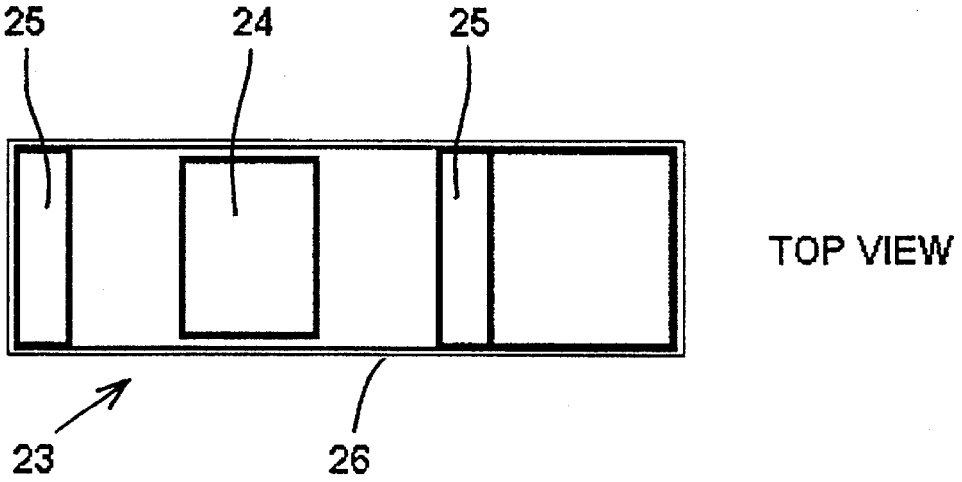
FIG. 5 illustrates a safety mechanism used in conjunction with the inventive device.

Preferably, the inventive device will be supplied with a safety, as shown in FIG. 5. Safety 23 comprises safety slide 24 formed of a magnetic material, mounted between opposing magnets 25 in channel 26 provided so that safety slide 24 is positioned below release member 17 by magnetic force, preventing depression of release member 17. By shaking the device, safety slide 24 is caused to move, whereby activation of release member 17 is made possible.

Various possible configurations of the extending members are shown in FIG. 4. FIG. 4*a* shows a key for use with the inventive device. Key 27 comprises key shaft 28 and key head 29. Key head 29 is provided with aperture 30 through which shaft 7 can pass. Key head 29 is further provided with engaging tooth 16 for engaging spring plate 20, and can further be provided with cut out portion 31 adapted to accept armature 22. As is shown, key head 29 can be modified to have a width equal to, or greater than that of key shaft 28. As an alternative, each of aperture 30, cut out portion 31, and engaging tooth 16 can be provided on socket 32, which is then affixed to key shaft 28 by set screw 33, as shown in FIG. 4*b*. Similarly, extending member 23 can be, among other things, a knife blade (see FIG. 4*c*) or an allen wrench (see FIG. 4*d*).

While only the fundamental novel features of the invention as applied to a preferred embodiment thereof have been expressly shown and described, it is understood that various omissions, substitutions, and changes in the form and details of the device illustrated and in its operation be made by those skilled in the art without departing from the spirit of the invention. It is therefore the intention of Applicant that the invention be limited only by the scope of the claims appended hereto.

I claim:

1. A device for selectively extending one member selected from a plurality of extending members having mounting apertures, when retained in said device said device comprising, a frame assembly comprising parallel side plates, including a first side plate and a second side plate, spaced apart from each other, a rear wall connecting said side plates at one longitudinal edge of said side plates and a bottom plate bridging said side plates at a bottom portion of said side plates, said side plates, rear wall, and bottom plate defining an open cavity of sufficient depth to allow for partial enclosure of extending members to be retained, said cavity being open in a frontal position parallel to said rear wall, and in a top position parallel to said bottom plate;

a hollow shaft extending between said side plates through throughholes, said shaft being capable of mating with mounting apertures of the extending members whereby the extending members can be rotatably mounted on said shaft, said shaft further having an open raceway formed therein;

a selector capable of selecting one retained extending member, said selector comprising a cylindrical member having a tailpiece extending therefrom, said selector being positioned within said hollow shaft with said tailpiece extending through said raceway to an exterior of said shaft whereby said shaft is capable of contacting a retained extending member selected for extension, said selector being movable within said shaft between said side plates, a selector control for controlling said position of said selector, a shaft biasing member for biasing said shaft to rotate between a closed position and an extended position, a retarding member preventing said shaft from rotating, and a release member for releasing said retarding member whereby said shaft is rotated by force of said biasing member.

2. The device of claim 1 wherein said extending members to be retained are keys.

3. The device of claim 2 wherein a head portion of at least one of said keys has a width equal to that of a shaft portion thereof.

4. The device of claim 2 wherein a head portion of at least one of said keys is replaced by a socket into which a key shaft extends.

5. The device of claim 1 wherein said extending members to be retained are allen wrenches.

6. The device of claim 1 wherein said extending members to be retained are knife blades.

7. The device of claim 1 wherein said frame assembly is two sections, a first section comprising said first side plate, said rear wall, and said bottom plate, a second section comprising a housing in which said selector control is disposed, a thickness of said second section being equal to a height of said bottom plate extending from said rear wall, whereby said second section can be mounted on said rear wall, and one side of said housing comprises said second side plate.

8. The device of claim 7 wherein said selector control moves said selector via a flexible connecting member with and against bias of a selector biasing member.

9. The device of claim 1 wherein said retarding member comprises a spring plate mounted on said rear wall, a first edge of said spring plate proximal to said shaft being caused to be spaced from said rear wall, said first edge engaging an engaging tooth of said shaft to prevent rotation thereof, activation of said release member causing depression of said spring plate whereby said engaging tooth is disengaged and said shaft is free to rotate.

10. The device of claim 9 wherein retained extending members are provided with engaging teeth which can be engaged by said first edge, whereby the extending members can be prevented from rotation until said release member is activated.

11. The device of claim 1 wherein said shaft is further provided with an armature capable of holding the extending members when retained until said release member is activated and being capable of aiding in the return of the extending members to a closed position.

12. The device of claim 1 further comprising a safety which, when engaged, prevents activation of said release member.

13. The device of claim 12 wherein said safety comprises a slide of magnetic material mounted in a channel between opposing magnets, whereby said slide is releasably retained under said release member by magnetic force, thereby preventing depression of said release member, tapping of said bottom plate causing movement of said slide whereby activation of said release member is possible.

14. A device for selectively extending one member selected from a plurality of extending members having mounting apertures, said device comprising;

at least one extending member, a frame assembly comprising parallel side plates, including a first side plate and a second side plate, spaced apart from each other, a rear wall connecting said side plates at one longitudinal edge of said side plates and a bottom plate bridging said side plates at a bottom portion of said side plates, said side plates, rear wall, and bottom plate defining an open cavity of sufficient depth to at least partially enclose said at least one extending member, said cavity being open in a frontal position parallel to said rear wall, and in a top position parallel to said bottom plate;

a hollow shaft extending between said side plates through throughholes, said shaft being adapted to mate with mounting apertures of said at least one extending member whereby said at least one extending member can be rotatably mounted on said shaft, said shaft further having an open raceway formed therein, a selector adapted to select one extending member, said selector comprising a cylindrical member having a tailpiece extending therefrom, said selector being positioned within said hollow shaft with said tailpiece extending through said raceway to an exterior of said shaft to contact one extending member selected for extension, said selector being movable within said shaft between said side plates, a selector control for controlling said position of said selector, a shaft biasing member for biasing said shaft to rotate between a closed position and an extended position, a retarding member preventing said shaft from rotating, and a release member for releasing said retarding member whereby said shaft is rotated by force of said biasing member.

* * * * *